US010339799B2

(12) United States Patent
Avni et al.

(10) Patent No.: US 10,339,799 B2
(45) Date of Patent: Jul. 2, 2019

(54) METHOD AND SYSTEM TO IDENTIFY CONGESTION ROOT CAUSE AND RECOMMEND POSSIBLE MITIGATION MEASURES BASED ON CELLULAR DATA AND RELATED APPLICATIONS THEREOF

(71) Applicant: CELLINT TRAFFIC SOLUTIONS LTD, Lod (IL)

(72) Inventors: Ofer Avni, Gizo (IL); Yossi Kaplan, Rishon Lezion (IL)

(73) Assignee: CELLINT TRAFFIC SOLUTIONS LTD, Lod (IL)

( * ) Notice: Subject to any disclaimer, the term of this patent is extended or adjusted under 35 U.S.C. 154(b) by 0 days.

(21) Appl. No.: 15/769,068

(22) PCT Filed: Aug. 24, 2016

(86) PCT No.: PCT/IL2016/050923

§ 371 (c)(1),
(2) Date: Apr. 18, 2018

(87) PCT Pub. No.: WO2017/037694

PCT Pub. Date: Mar. 9, 2017

(65) Prior Publication Data

US 2018/0308350 A1 Oct. 25, 2018

Related U.S. Application Data

(60) Provisional application No. 62/211,793, filed on Aug. 30, 2015.

(51) Int. Cl.
*G08G 1/01* (2006.01)
*G08G 1/14* (2006.01)

(52) U.S. Cl.
CPC ..... *G08G 1/012* (2013.01); *G08G 1/0133* (2013.01); *G08G 1/14* (2013.01)

(58) Field of Classification Search
CPC ..... G08G 1/012; G08G 1/0133; G08G 1/14
See application file for complete search history.

(56) References Cited

U.S. PATENT DOCUMENTS

| | | | | |
|---|---|---|---|---|
| 6,577,946 | B2 | 6/2003 | Myr | |
| 7,936,284 | B2 | 5/2011 | Levine et al. | |
| 2003/0069683 | A1* | 4/2003 | Lapidot | G01C 21/34 701/117 |
| 2010/0140207 | A1 | 5/2010 | Pittman et al. | |
| 2010/0292921 | A1 | 11/2010 | Zechariah et al. | |
| 2013/0101159 | A1* | 4/2013 | Chao | G06K 9/00771 382/103 |
| 2016/0153804 | A1 | 6/2016 | Fowe | |

* cited by examiner

*Primary Examiner* — Russell Frejd
(74) *Attorney, Agent, or Firm* — Smith Tempel; Gregory Smith

(57) ABSTRACT

A system and method that analyzes root cause of congestion at specific road sections.
A system and method that differentiates between travelers using different modes of transportation.
A system and method that analyzes root cause of parking overload.
A system and method that performs demographic analysis of people travelling at specific road sections.
Certain embodiments of the above systems and methods use data derived from cellular networks.
Certain embodiments of the above systems and methods teach real time analysis while others teach non real-time analysis.

7 Claims, No Drawings

METHOD AND SYSTEM TO IDENTIFY CONGESTION ROOT CAUSE AND RECOMMEND POSSIBLE MITIGATION MEASURES BASED ON CELLULAR DATA AND RELATED APPLICATIONS THEREOF

BACKGROUND ART

There are several ways that can be utilized in order to solve and mitigate congestion, starting from real time measures, such as changing traffic light timing, ramp metering and routing driver with road message signs and up to infrastructure changes such as adding lanes, bridges and toll facilities to reduce demand. In addition there are measures related to providing alternative transportation means, like public transportation, such as adding bus routes between destinations or increasing the frequency of public transportation schedules.

All these methods require proper data in order to make decisions: data about the congestion, data about the public transportation, and origin destination data. Previous methods to collect origin destination data of those people stuck in the traffic congestion included means such as number plate reading and then tracking these people to their home address based on car license registration databases. Such solutions are only relevant for one destination (home) and not for work place or any other destination, require field equipment deployment and maintenance, which is very expensive, create dangerous traffic obstacles, require right of way and complicated co-ordination, and the data is limited to the deployment points. It is also compromising on people's privacy, requiring up-to date license/address databases which is not updated in many countries and doesn't function at all with some types of license plates.

Other methods include stopping cars in the middle of the street and asking them their origin destination—very dangerous and with no statistical significance, or phone surveys, which relies on people's memory and are very un-reliable.

Some companies are using cellular origin destination data for this purpose. However, such data which is extracted passively from the cellular network is not accurate enough to identify the exact road on which the phone is traveling, since most antenna towers cover more than one road, thus it is not relevant for origin-destination (OD) analysis of a specific road, street block or junction.

In U.S. Pat. Nos. 6,947,835 and 7,783,296 Kaplan et al demonstrated methods to correlate a phone to a specific route, based on passive communication with the network and find its accurate location, but the data used is local by its nature and can't enable wide-coverage origin destination analysis. However, it does provide a necessary building block for a possible solution that will be described in this invention, by assigning phones to the exact road section they are traveling on.

There is a need to develop a system and a method for a more comprehensive and cost effective way to perform origin destination analysis of people who are stuck in a specific congestion, in order to understand the root cause of such congestion and possible curing methods.

SUMMARY OF INVENTION

A method to analyze cellular information for detecting root cause of congestion and mitigation measures.

DESCRIPTION OF INVENTION

Cellular control channel data is extracted from cellular networks, either by means of network connection, or through interface at the mobile handset or through any other way, and location is determined by one or more of the known location methods.

The system records the location information from the network for all phones in the relevant covered area and stores it in a location database. Where possible, the system is correlating each phone which is traveling with a specific route section, either on a road, street or rail or any other means of transportation.

The system identifies route sections under congestion and the relevant time by analyzing the cellular data or by receiving it from external information source.

The system identifies phones which are at a specific congested route section and extracts their historical locations from the location database.

The system analyzes their historical locations to find out their destinations (OD) and/or travel patterns. This analyzed information can include for example home neighborhood, work area, shopping areas they visit, type of transportation they use (such example is detailed below), routes they use in their private cars, rerouting options they take, etc.

The system then calculates the percentage of people coming from each zone into this congestion (zone can be a road segment, a junction, a neighborhood, an industry zone, a shopping mall, or any other zone to be defined in the analysis system) and the distribution of the destinations they are heading to.

In cases of recurrent congestion, such analysis can group data from several occurrences of the same congestion The system then provides a list of the origins and destinations and combinations of a specific origin and a specific destination, that are contributing the larger amount of cars and/or travelers to the congestion (impact rate), and list them according to that impact rate.

The system can then look for mitigation measures that can be utilized to mitigate or eliminate such congestion. Such mitigation measures can include changes in public transportation (station location, new lines or frequency as detailed below), delaying some of the traffic in previous traffic lights on smaller corridors in order to eliminate the congestion in the main traffic routes, etc.

The system also compares the travel patterns and/or OD behavior in congestion times to the travel patterns and/or OD behavior in other times and analyzes the differences between them to identify the root cause for congestion Examples for Mitigating Congestion Based on Travel Patterns and/or OD Analysis 1. If 20% of the cars that were detected in congestion in route section X between 11:00 to 11:30 am on Sunday morning come from a neighborhood Z on their way to a shopping mall Y, the system will check if there are bus lines connecting the two points, and if the station is within walking distance, and if yes—it will recommend to check whether to increase the frequency of this line during this time period.

2. If proper bus frequency is already available and not used in full, the system can analyze if most of these people are going to other destination L after/before Y, that require a private car since public transportation is not available or is only partially relevant between L and Z, or between L and Y.

3. If such destination L is found, the system can recommend changes in public transportation accordingly, such as adding a bus line or between L and Z or between L and Y respectively, or adding a bus station for existing bus line at one or more of these destinations.

4. The system can also recommend to change traffic lights plans on Sunday morning in selected junctions between Z and X in order to reduce car volume in X and at the same time encourage people from Z to use the bus, since their travel time by car will increase and will be less attractive relative to the bus.

5. Such solutions can be also implemented to provide mitigation measures in real time based on the congestion detection and the root cause analysis, such as increasing bus line frequency, changing traffic light to reduce volume of cars entering the congestion or increase number of cars leaving the congestion, etc. Changes that require infrastructure changes, such as adding a new bus station, are not relevant to implement in real time and will not be used in this context.

Using Similar Method to Manage Parking

Same analysis can be applied to other types of problems, such as parking overload in an industry zone or shopping mall, sports event or festivals, etc. In such case people looking for parking can be identified based on them driving in circles looking for parking around the relevant location, or by identifying them initially on the road and then within the relevant location.

A parking overload event can be detected based on high occupancy levels at parking lots, and number of cars driving around looking for parking, or time it takes from arriving to the relevant location until entering the facility. All these factors can be compared at different times to identify times of regular load and times of overload.

External data such as the parking lot occupancy can be used to calibrate the parking load information from the cellular network.

Same solution as mentioned above using public transportation and traffic light tuning can provide mitigation measures in this case as well.

Such method can be used to manage parking issues in real time as well. Based on the detection of the parking problem in real time, as well as on the number of cars entering a specific zone exceeding regular parking load.

The system also compares the travel patterns and/or OD behavior in parking overload times to the travel patterns and/or OD behavior in other times and analyzes the differences between them to identify the root cause for parking overload Differentiating Between Types of Transportation:

In order to identify root cause and possible mitigation solutions it is important to differentiate between modes and types of transportation. An important embodiment of this invention is a method for differentiating between modes of transportation tracked through the cellular network. The method comprises of:

1. Collecting signaling data from the cellular network

2. Identifying combinations of location and/or times where the travel patterns of the phones are different between different types of transportation 3. Assigning phones a tag of the relevant transportation mode Differentiating between buses and regular transportation is more challenging, but can be done in a reliable manner. Since busses carry several people usually, in places where the location area is changed, the network is communicating with all the phones, so all of the relevant phones will be detected at that point at the same time. Two such points can be used to define a specific bus line to which this bus is related at 95% of the cases.

Once these phones are correlated to a bus, and the bus route is known, we can continue tracking them and detect the location of the bus along the route, while correlating other phones to that bus when they are active, and continue tracking the bus through them as well.

Another way to differentiate users of public transportation from private cars is by identifying their phones in area where only public transportation is served by the network, such as subways, or roads and directions which only public transportation is allowed.

Another way to differentiate users of public transportation from private cars is by analyzing their routes vs. origin destination and final destinations. On a statistical basis, these commuters will not use the fastest way between their origin and destination, since they are constrained by the routes of the public transportation lines.

Another way to differentiate users of public transportation from private cars is by analyzing their travel times vs. car traffic patterns from their origin destinations to their final destinations during the relevant travel times. On a statistical basis, for these commuters it will take longer time to arrive from origin to destination than the cars during free flow time, and faster during congested times in some routes. The analysis should take into consideration the specific characteristics of the road traffic and the public transportation characteristics, such as special lanes for busses and train speeds.

Once a phone profile is generated, whether it uses cars/truck or public transportation of any kind, in what times and conditions for each mode, each time this phone will be reported on the cellular network, a flag can be assigned to it according to the probability of mode of transportation it uses at that specific time/route.

Based on data from the rest of the trip, we can detect/calculate in which station they dropped off the bus, and if they switched to another line or mode there. If they arrived at their destination after the 1st bus, they will be detected there several times following arrival. If they continue to another route and will be correlated to it, we can see where the two lines meet to identify the changing station.

Counting

Differentiating between modes of transportation enables to filter out from the car counting passengers of public transportation, so the phones correlated to a specific road section will be traveling in private cars, and vice versa. The places where location areas are crossed, and all phones are detected can be used to calibrate the number of active phones with the number of total phones, and a few field sensors can be used to find the ratio between passengers and drivers in order to calculate the volume of cars passing at a specific point.

Differentiating Between Types of Vehicles:

In order to identify root cause and possible mitigation solutions it is important to differentiate between types of vehicles. One of the ways to differentiate between types of vehicles is to track their origin destination patterns. Commercial vehicles will have a different pattern than commuters that drive from home to work most of the time. Cars which travel to multi destination most of the days, are considered commercial vehicles.

There is also a difference in time of day travel, for example commercial vehicles drive often during nights and early morning hours, and trucks usually do not drive during weekends and holidays.

Within this Category, there are Several Sub Categories that can be Differentiated An important embodiment of this invention is a method for differentiating between types of vehicles tracked by the cellular network. The method comprises of:

1. Collecting signaling data from the cellular network

2. Identifying combinations of location and/or times where the driving patterns are different between different types of vehicles 3. Analyze signaling data from road sections and/or times with similar characteristic to separate a specific type of vehicles from the other vehicles One way to differentiate between types of vehicles, as an example, by detecting those vehicles which travel to the same destinations every day or every week, or to a known sequence of destinations, are most likely to be supply cars. Those which drive every day to multiple new destinations and stay for short period in each destination, without any specific patterns, are most likely to be service cars. Vehicles which are going from a "home destination" and go back there several times a day are most likely to be a delivery car. If the "home destination" is within an industry zone, or a large truck parking, this will be another indication, etc.

Another differentiation method is the speed/acceleration patterns. Heavy trucks have different speed limit on many roads, and are accelerating slower after red light. The heavier the trucks are, they will drive slower on a statistical basis when climbing a long up-hill road, especially with a lot of turns. High variance of speed at each road section can be used as criteria whether to use them for this analysis or not.

Trucks can also be identified based on their night parking at designated trucks parking.

At the same time, two wheels (e.g. city motorcycles, electric bikes, etc.) can be differentiated by their speed patterns as well. On one hand they will be accelerating faster after red light, and on the other hand they will go slower than average cars during free flow times on fast roads. These same two wheels can go faster than average traffic during congested times, since they can sneak between cars and move to the front of the queue at the traffic light during red light stop.

Large motorcycles will have other characteristics, such as accelerating faster after traffic light and by passing congestion on freeways, while driving at the average speed in dense streets of city traffic. Differentiation between types of motorcycle can also be done based on the roads they are driving on. City motorcycles are less likely to go on freeways, etc.

Regular bicycle can be differentiated by their low average speed in long up hill climbing, as well as going faster than cars during bad congestions, etc.

4 wheels drive can be differentiated based driving off road on routes which regular cars can't drive through.

There are also routes or route segments on which travel of specific types of vehicles are forbidden, either totally or during specific times. For example private vehicles in city centers, commercial vehicles during rush hours etc. These limitations can be also used to identify vehicle type.

The ability to find the route and exact location of a mobile phone will be used solely or in conjunction with additional information to determine the mobile phone vehicle type.

Using Classification of Transport and Vehicles for Real Time Information

Once a classification tag and/or origin destination profile was assigned to a phone, this can be used for real time analysis and reporting as well. For example, when reporting real time speed of traffic or travel time, trucks, busses and motorcycles can be filtered out from the calculation or treated separately in the calculation, for example to measure the speed on an HOV lane in cases such as when there is a bus line that uses the HOV lane only, or the regular lane only.

Differentiating HOV Lane

Differentiating HOV lane can also contribute to root cause analysis. This can be done based on quantities of each speed distribution. At times of average speed difference between regular lanes and HOV (high occupancy lane), the accurate location and speed measurements will reveal two sets of speed distribution. The distribution with the higher number of samples can be identified as the regular lane distribution, and the other way around.

Another way to separate cars on the HOV lane from regular traffic is by the special exits and entrances that are not service the HOV, or only serving the HOV, Demand Analysis Per Road in Real Time Some of the measures based on the real time root cause analysis can be taken before the problem started, by combining the counting and calcification methods described above.

For this purpose, there is a need to predict what will be the travelers load on various routes in order to give priority to these routes for the purpose of optimizing capacity and improve travel times. The cellular network enables detecting all phones when they are crossing between location areas. Building a profile of typical origin destination and routes used per each anonymous phone, can include the cell ID and other parameters of any crossing between location areas. Aggregating this data in real time, and comparing the typical routes with the current crossing at a specific point, can enable the transportation manager to predict how many cars will arrive at a specific road section within the next hour, and based on this to prioritize traffic signals and public transportations.

For example, if Car A passes through a location area border every morning at 7:15 at cell X, and travels later through highway one to work place, all this data will be aggregated into the database. Then, if at a specific day it pass the location area at cell B on 7:25, we know to expect it on highway One 10 minutes later if the traffic is the same, or 15 minutes later, if typical travel time changes by 5 minutes at that new time comparing to the old time. Based on such analysis for all phones in the network at each specific day, we can estimate the changes in number of cars on highway One on each specific morning, and the resulted traffic conditions, and recommend calming measures. Route and location The current invention teaches the generation of a database that stores mobile units exact route and location at the time of specific network events. These network events consist of all events that include cell-ID. Location area, service area and any other cellular and other data indicating location or area change of the mobile unit.

When the activities of a mobile unit are gathered from several sources that include cellular network data, and analyzed in real-time or non-real-time, a cellular event or sequence of events will be used to detect the mobile route and/or location and/or travel direction.

This analysis may be done independently or in conjunction with additional information on the mobile unit and/or vehicle profile.

For example if the information gathered from the cellular network for a specific mobile, indicates when matched with the database described above of several routes and locations for this vehicles, and from the vehicle profile it is recognized as a bus than the location will be narrowed to include only routes that are used for bus travel.

Advanced classification as mentioned above, can help in more sophisticated analysis.

Time to Arrive at a Train Station, and Time to Wait There

One of the needs of road agencies is to know how long it takes for commuters to arrive at a train station, and how long they wait for the train, as well as how long it takes them to arrive to their destination. Since the cellular data is not continuous, it is hard to know when someone left home and arrived to the station, and the same when going back from work to home. Another significant embodiment of this invention is a method to extract this data from the network. The analysis can be done as follows: each time we track a commuter on the train, we will track him/her back to see when that train passed at his station, so we can tell the time the person went on board the train.

For each person, we can identify home address based on the cells that person was near-by during late night time, for the last few days.

For each such event, we can look what was the last time that person was communicating through the network at home, and measure the time between then and the time he got into the train.

When analyzing many events such for that person, we can tell what was the typical shortest time it took for a person to arrive on the train from home, and use this as the regular travel time between home and the station.

Than we can deduct that regular travel time from the time gap between home and the train each day, and get the distribution of waiting time at the station and at home (together).

Each time the time gap is larger than the scheduled time difference between two trains of the same line, we can filter it out.

For the rest of the measurements, we can assume that the time a person waits at the station and the time he is delayed at home after the last network communication are equal on a statistical basis when calculating the average of many measurements.

We can do this calculation for all people living at the same building block and get the average and distribution of time a person is waiting in the train station for the train.

The same analysis can be done when going from work to home on the opposite direction.

Demographic Analysis of People Travel at a Specific Road Section

In order to decide on a new bridge location, or a new branch of a commercial company, or to compare business or real estate locations, there is a need to determine the type of population traveling through a specific road section at a specific time of day/day of week, and what mode of transportation they used.

Kaplan et al demonstrated how a car can be correlated to a specific road, and its location can be determined relatively accurately, pinpointing the exact street the car/passenger are traveling on, and the exact location on that street in short intervals. Tracking the same car to its routine places, can provide important information about each person. Home neighborhood can be determined according to where that person stays at night times. Work location—according to location during day time. Routine visits to country club, theaters and restaurants, can also be identified. The economical level of the home neighborhood, the industry zone and the other places that person visits, can provide good indication on his socio-economic status. In addition, matching this data with profiles of the people that are around this person, can provide an important input to this equation of socio-economic status. All this information can be used to evaluate the potential income of a business at a specific street corner, or a specific block, based on the population that travels there, and can be diverted to there.

Such analysis can be used to compare between competing businesses, identify which population is visiting each of them, as well as make decisions which marketing campaigns should be utilized and where in order to provide the best benefits to the business.

Active Queries:

In places where critical data is missing, the system can generate active queries to specific phones, after such phones passes at a known location, in order to receive more continuous data on its route. Such queries can be generated as blank SMS or other means to avoid disrupting the users, and can be done while maintaining the ID of the phone encrypted, so no privacy violation will occur. This can also be used to collect data for a specific phone in order to validate the mode of transportation and/or type of vehicle used.

System and Method:

The above described method can be implemented also as a system and vice versa. Such a system requires a connection to the cellular network, a server to extract signaling data from the cellular network and analyze the OD data and/or travel time patterns as described above, and a connection to provide reports and recommendations from the system. Such system can also receive external data to improve its performance, like in the case of parking overload.

The invention claimed is:

1. A method for analyzing a root cause of congestion at a specific route section, the method comprises the actions of:

identifying people who travel at the specific route section during congestion;

examining data to track the people that were detected on that specific route section during congestion and identifying travel patterns before and after they were detected on the specific route section; and identifying origins, destinations or combinations thereof, that are contributing the larger amount of cars and/or travelers to the specific route section thereby causing the congestion.

2. The method of claim 1, wherein the data is derived from a cellular network.

3. The method of claim 1, wherein further analysis is done to compare between the travel patterns data in congested times and travel patterns data in other times to derive routing changes.

4. The method of claim 1, wherein the actions are done in real time in order to handle congestion in real time.

5. A method for analyzing a root cause of congestion at a specific route section, the method comprising the actions of:

collecting signaling data from a cellular network;

identifying people who travel at the specific route section during congestion;

tracking the people that were detected in the congestion and identifying the root cause of the congestion by analyzing Origin Destination (OD) data before and after they were detected on the specific route section; and identifying origins, destinations or combinations thereof, that are contributing the larger amount of cars and/or travelers to the specific route section thereby causing the congestion.

6. The method of claim 5, wherein further analysis is done to compare between the OD data in congested times and OD data in other times.

7. The method of claim 5, wherein the actions are done in real time in order to handle congestion in real time.

* * * * *